United States Patent [19]

Kahler

[11] Patent Number: 4,819,946

[45] Date of Patent: Apr. 11, 1989

[54] BULLET TRAP

[76] Inventor: James E. Kahler, 2212 Westport Rd., Peoria, Ill. 61615

[21] Appl. No.: 105,327

[22] Filed: Oct. 7, 1987

[51] Int. Cl.[4] ..... F41J 1/12

[52] U.S. Cl. ..... 273/404; 273/410

[58] Field of Search ..... 273/403, 404, 407, 409, 273/410; 73/167

[56] References Cited

U.S. PATENT DOCUMENTS

| | | | |
|---|---|---|---|
| 1,992,001 | 2/1935 | Caswell | 273/410 |
| 3,122,367 | 2/1964 | Dale | 273/404 X |
| 3,197,207 | 7/1965 | Sanzare | 273/410 |
| 4,445,693 | 5/1984 | Angwin | 273/404 |
| 4,458,901 | 7/1984 | Wojcinski | 273/410 |
| 4,470,604 | 9/1984 | Hoffmann | 273/404 |

FOREIGN PATENT DOCUMENTS

| | | | |
|---|---|---|---|
| 8501320 | 12/1985 | Netherlands | 273/409 |
| 618259 | 7/1980 | Switzerland | 273/404 |

*Primary Examiner*—Robert E. Garrett
*Assistant Examiner*—Joseph M. Pitko
*Attorney, Agent, or Firm*—Senniger, Powers, Leavitt and Roedel

[57] ABSTRACT

A portable bullet trap device for catching bullets fired at the device comprising a box having a bottom, a top, and front, back, and opposing sides. The front has an opening for the passage of bullets fired at the device. A plurality of vertically oriented resilient panels are provided in the box aligned with the opening in the front. The panels are spaced from each other to form spaces between the central portions of the panels through which spent bullets can fall if they cannot penetrate the next successive panel. The panels may be provided as a replaceable cell having spacers between the marginal edges of the panels. Alternatively, the panels may be separately mounted in slots in the opposing sides of the box. A target means is provided to spread shots over the panels. This target means comprises at least two target sheets, each sheet adapted to be positioned over the forwardmost panel of the device and having at least one target thereon located over a different portion of the panel than the target on the other sheet when the sheets are positioned on the panels.

19 Claims, 4 Drawing Sheets

BULLET TRAP

BACKGROUND OF THE INVENTION

This invention relates to bullet traps, and in particular to portable bullet traps for target practice to catch and collect spent bullets.

The bullet traps previously available have generally been large and complicated devices and therefore have been expensive. These bullet traps usually took up alot of space and were often so large and heavy that they required permanent installation. Examples of some prior art bullet traps are shown in U.S. Pat. Nos. 1,992,001, 3,197,207, 4,470,604, and 4,458,901. It has thus been difficult for individuals, small police departments, and other small organizations to have the proper equipment for target practice. In many cases the limited use such equipment would receive simply did not justify the cost or the space required to erect a bullet trap. Thus, there has been a need for an inexpensive, convenient, portable bullet trap device for target practice.

SUMMARY OF THE INVENTION

It is among the objects of the present invention to provide a bullet trap device for target practice to catch and collect bullets; it is a further object to provide such a device that is of simple and inexpensive construction; it is a further object to provide such a device that is compact and lightweight so that it can be easily moved, and which does not require permanent installation or extensive set up. It is also among the objects of the present invention to provide a replaceable bullet trap cell for bullet trap devices that is of simple construction and inexpensive enough to be disposable; it is a further object to provide such a cell that is reversible to reduce the frequency of replacement; it is a further object of this invention to provide such a cell that stops bullets fired into it and allows them to fall free of the cell for collection. It is also among the objects of the present invention to provide a target means for a bullet trap device to distribute the shots evenly over the device to prevent coring of the bullet trap device and to maximize the life of the device.

Generally, the bullet trap device of the present invention comprises a box having a bottom, a top, and front, back, and opposing sides extending between the bottom and the top. An opening is provided in the front for the passage of bullets fired at the device. A plurality of vertically oriented resilient panels are mounted in the box, aligned with the opening in the front. The panels are spaced from each other to form open spaces between the central portions of successive panels through which spent bullets can fall if they cannot penetrate the next successive panel.

The bullet trap device can include a space in the box below the panels for spent bullets to collect. The panels may be spaced from each other with spacers joined to the marginal edges of successive panels. The spacers are preferably located at the top and sides of the cell, leaving the bottom unobstructed for the passage of spent bullets. Alternatively, the panels may be spaced by mounting their marginal side edges in pairs of aligned slots in the opposing sides of the box.

The bullet trap device can include target means for distributing the shots over the device. This target device comprises at least two target sheets, each adapted to be positioned over the forwardmost panel, and having at least one target thereon. The target on each sheet is located over a different portion of the panel than the target on the other sheet, to distribute the shots over the surface of the panels and thereby extend panel life.

Another aspect of the present invention is a replaceable bullet trap cell for installation in the bullet trap device. The cell generally comprises a plurality of panels of resilient material aligned in face-to-face relation. Spacers are sandwiched between successive panels, generally adjacent the marginal edges of the panels to provide open spaces between the central portions of successive panels through which spent bullets can fall if they cannot penetrate the next successive panel. The spacers are preferably positioned at the top and side edges of the panels, leaving the bottom unobstructed for the passage of spent bullets. It is preferable that the cell include a sufficient number of panels to be reversible, to reduce the frequency of replacement. The panels may also include a layer of fiber reinforcement.

The bullet trap device of the present invention provides a backstop for target practice to catch and collect spent bullets. The device is of simple and inexpensive construction. It is compact and lightweight so that it can be easily moved, and it does not require permanent installation or extensive set up.

The bullet trap cell of the present invention provides a replaceable cell for the bullet trap device that is of simple construction, and inexpensive enough to be disposable. The cell can be made sufficiently thick to be reversible to reduce the frequency of replacement. The multi-panel construction stops bullets fired into the cell and allows them to fall from between the panels for collection.

The target means used with the bullet trap device and bullet trap cell provides multiple targets substantially over the surface of the device distributing shots more evenly over the device to prevent coring of the bullet trap device and cell and to maximize the life of the device and cell.

These and other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
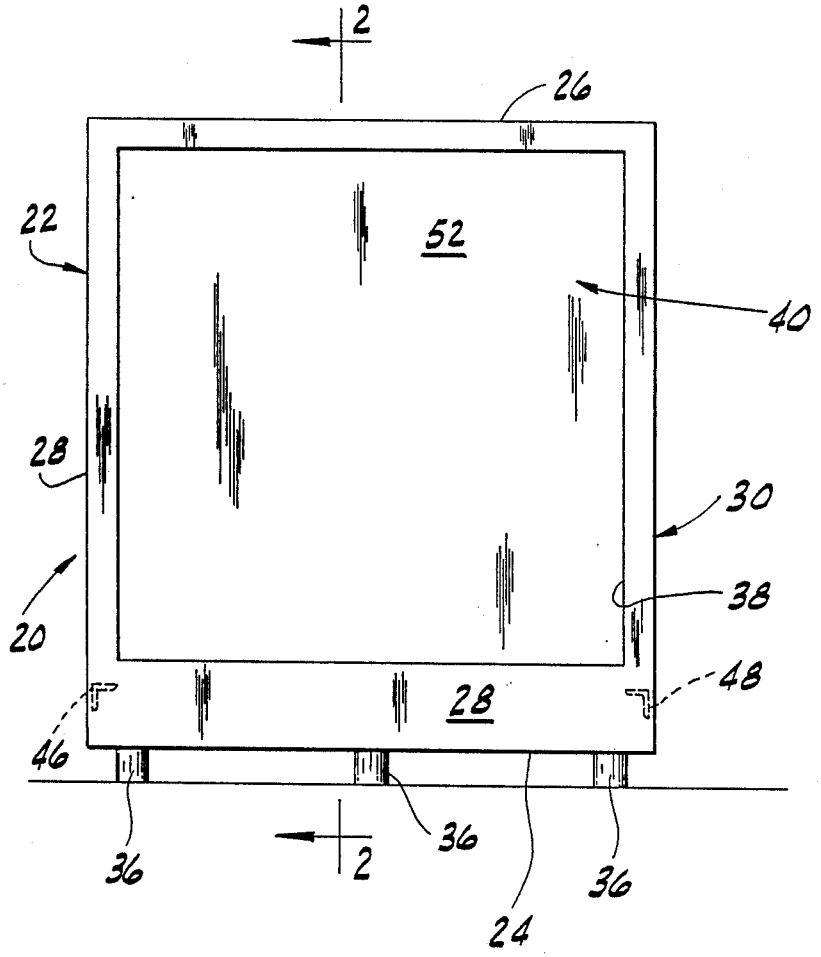
FIG. 1 is a front elevation view of a first embodiment of a bullet trap device constructed according to the principles of this invention.
Figure 2:
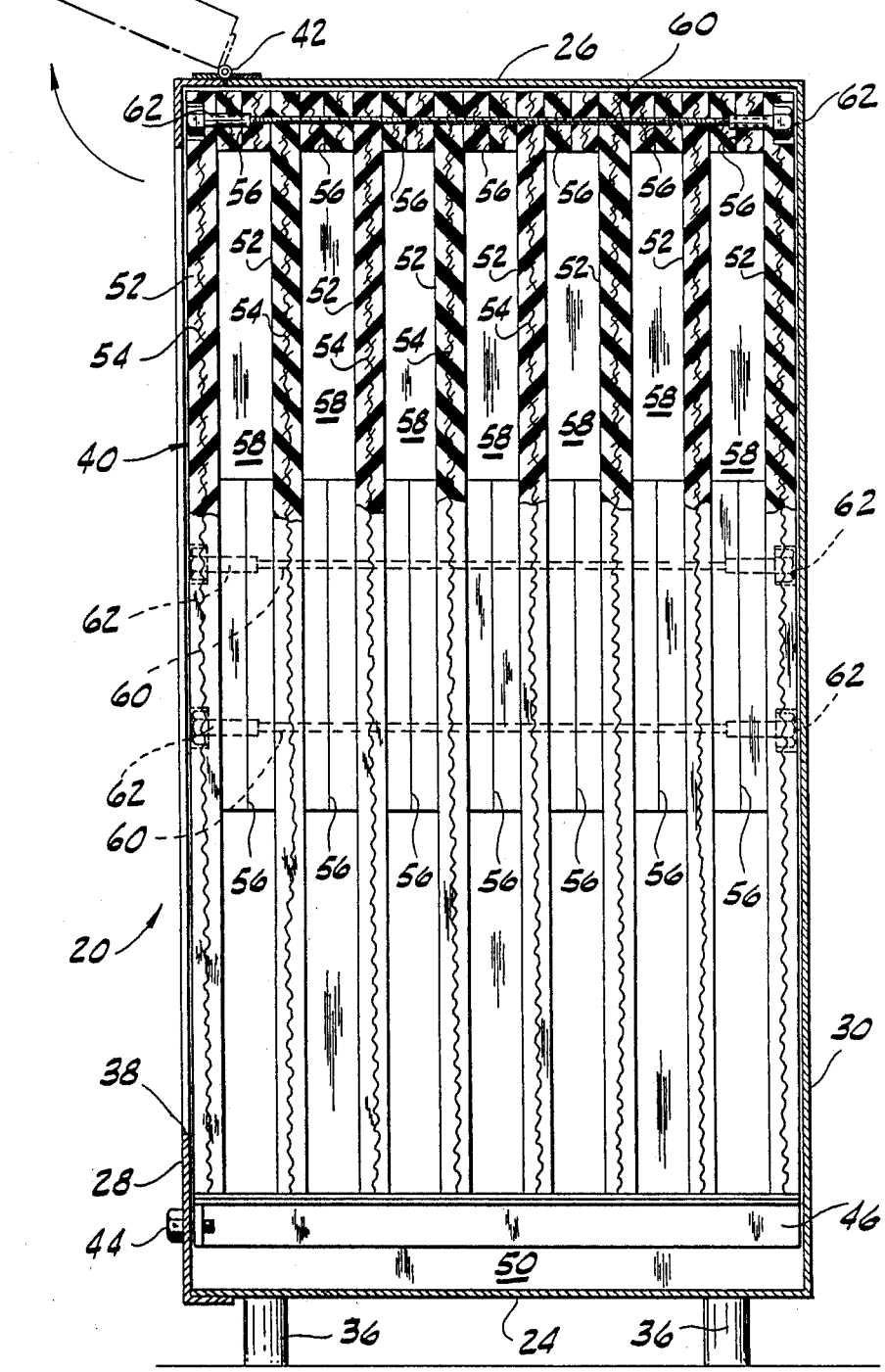
FIG. 2 is a side cross-sectional view of the bullet trap device, taken along the plane of line 2—2 in FIG. 1.

A first embodiment of a bullet trap device constructed according to the principles of this invention is indicated generally as 20 in FIGS. 1 and 2. The device 20 comprises box 22 having a bottom 24, a top 26, and front 28, back 30, and opposing sides 32 and 34 extending between the bottom 24 and the top 26. The box 22 may be provided with legs 36 depending therefrom. The front 28 has an opening 38 therein for the passage of bullets fired at the device.

The box 22 is adapted to receive a replaceable bullet trap cell 40. As shown in FIG. 2, the front 28 can be hingedly mounted, as with hinge 42, to the top 26 so that the box 22 can be opened to insert or remove bullet trap cell 40. The front 28 can be releaseably secured with bolt 44. The box 22 preferably has two supports, such as angle irons 46 and 48, on the sides 32 and 34, respectively, to support the cell 40 above the bottom of the box 22, in alignment with opening 38 in the front 28. There is thus a space 50 below the cell 40 at the bottom of the box 22 for spent bullets to collect.

The bullet trap cell 40 comprises a plurality of resilient panels 52. As illustrated in the drawings, the panels 52 are preferably made of rubber. The panels 52 preferably are at least one-half inch thick and have at least one reinforcing layer 54 of woven material. The panels 52 can be made inexpensively from used conveyor belt material. In the preferred embodiment, the cell 40 comprises eight panels 52. It is expected that in normal use a bullet will penetrate no more than four panels, thus eight panels are sufficient to allow the cell 40 to be reversed to increase the time between cell replacements.

The panels 52 are separated by spacers 56 at the marginal edges of the panels 52. The spacers 56 space the panels 52 from each other to form open spaces 58 between the central portions of successive panels through which spent bullets can fall if they cannot penetrate the next successive panel. These spacers 56 can be made from strips of the same material that the panels 52 are made from, although as shown in FIG. 2, the strips may be doubled to obtain satisfactory spacing. The spacers 56 are preferably aligned in rows. The spacers 56 and panels 52 may be secured together with threaded rods 60 and threaded end caps 62. In the preferred embodiment, a pair of threaded rods are used to secure each row of spacers. Alternatively, adhesive or some other means could be used. The spacers 56 are preferably positioned at the top and the sides of the panels 52, but not at the bottom so that the bottom of the cell 40 is open for the unobstructed passage of spent bullets.

Cell 40 is supported in box 22 so that the panels 52 are vertical, generally parallel to the opening 38 in front 28, and perpendicular to the direction of travel of bullets fired into the device.

Figure 3:
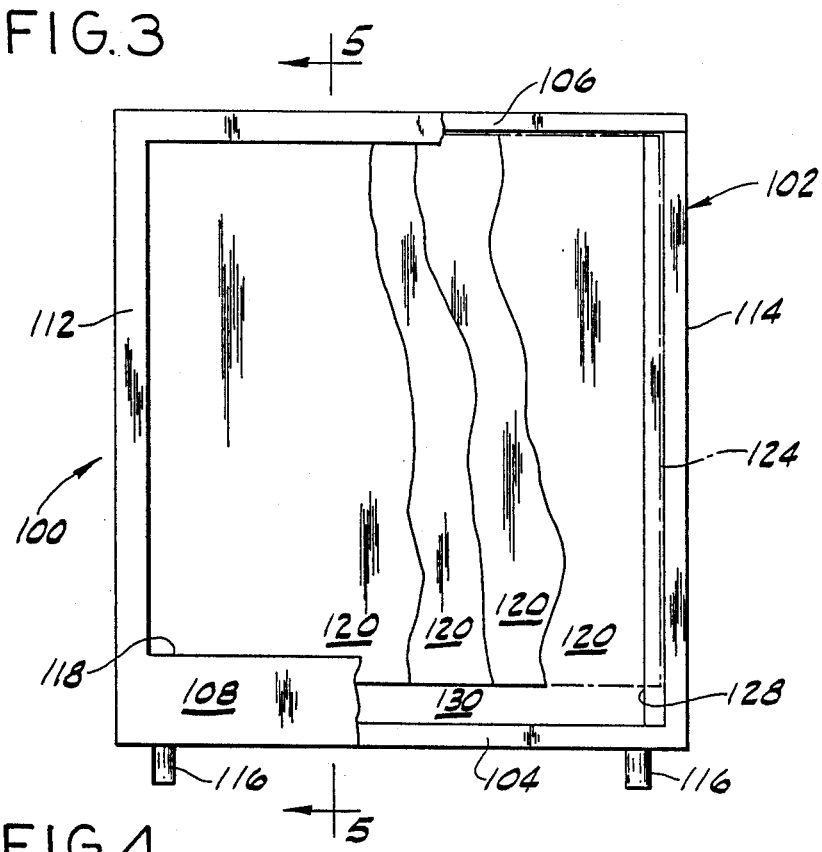
FIG. 3 is a front elevation view of a second embodiment of a bullet trap device constructed according to the principles of this invention, with portions broken away to show several of the panels.
Figure 4:
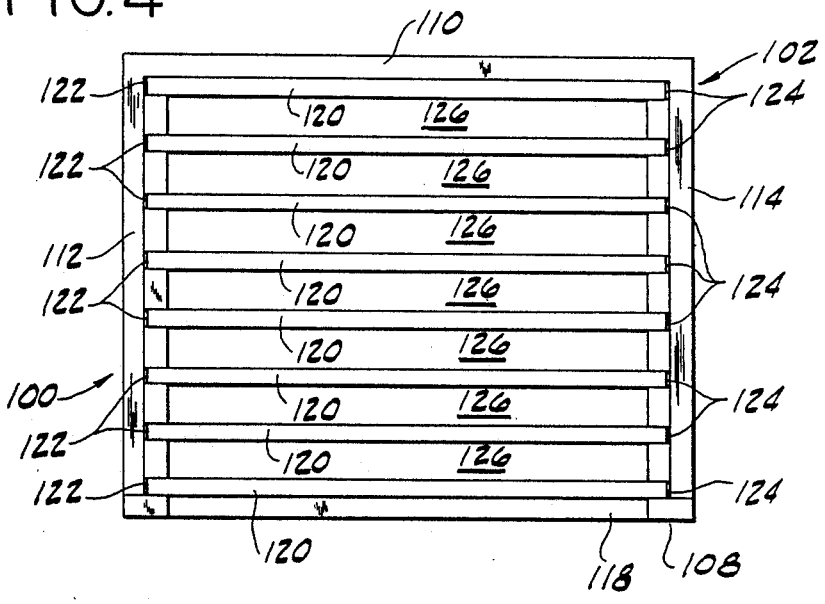
FIG. 4 is a top elevation view of the bullet trap device in FIG. 3.
Figure 5:
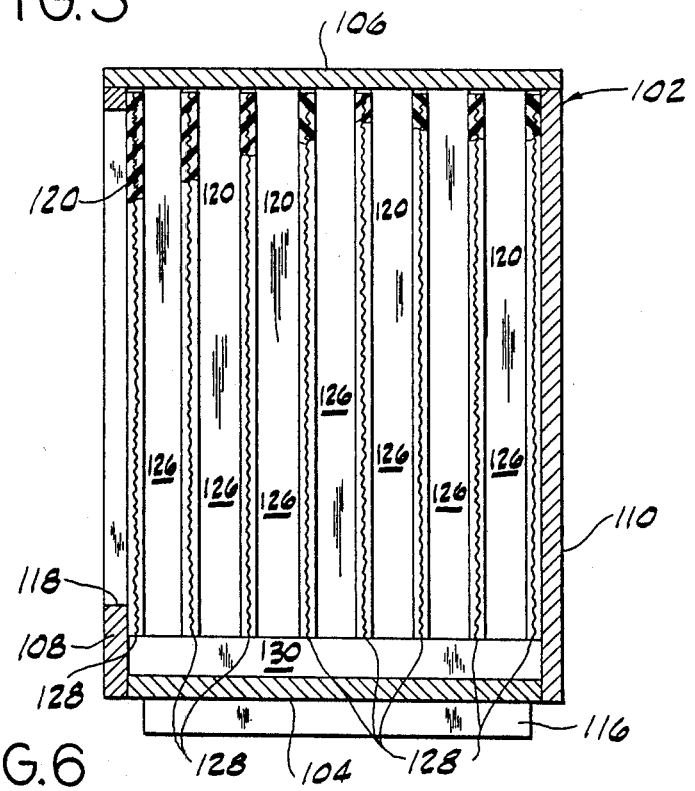
FIG. 5 is a side cross-sectional view of the bullet trap device taken along the plane of line 5—5 in FIG. 3.

A second embodiment of a bullet trap device constructed according to the principles of this invention is indicated generally as 100 in FIGS. 3-5. The device 100 comprises box 102 having a bottom 104, a top 106, and front 108, back 110, and opposing sides 112 and 114 extending between the bottom 104 and the top 106. The box 102 may be provided with legs 116 depending therefrom. The front 108 has an opening 118 therein for the passage of bullets fired at the device.

The box 102 is adapted to receive a plurality of replaceable resilient panels 120. The panels 120 are preferably identical to the panels 52 described above. The panels 120 are mounted generally vertically in box 102, parallel to the opening 118 in front 108, and perpendicular to the direction of travel of bullets fired into the device. This mounting is accomplished by mounting the side edges of the panels 120 in vertical slots 122 and 124 in opposing sides 112 and 114, respectively. The top 106 is preferably hinged to the back 110, or one of the opposing sides 112 or 114, to allow the top 106 to be opened to give access to the interior of the box 102 to insert or remove the panels 120. Although as few as four panels 120 should be sufficient for most purposes, for added safety and for convenient storage of replacement panels, slots sufficient for eight or more panels may be provided in the box 102. The slots 122 and 124 for mounting the panels are spaced from each other to space the panels 120 from each other to form open spaces 126 between the central portions of successive panels through which spent bullets can fall if they cannot penetrate the next successive panel. The slots 122 and 124 in the sides 112 and 114 of the box 102 preferably terminate above the bottom 104 of the box 102, each forming a shoulder 128 to support the panels above the bottom of the box and form a space 130 at the bottom of the box for spent bullets to collect.

Figure 6:
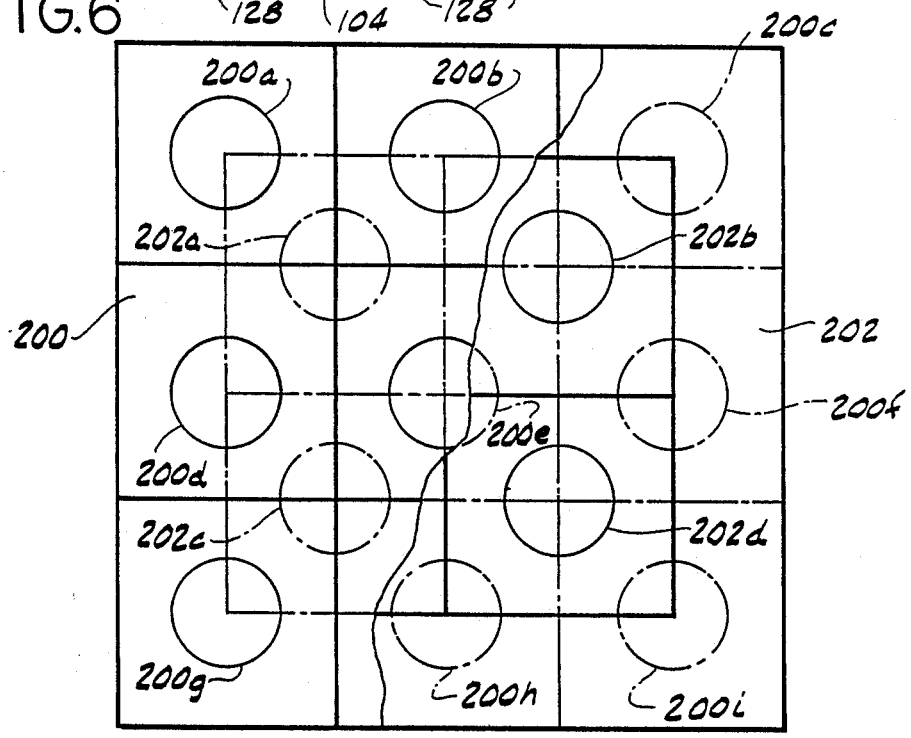
FIG. 6 is a plan view of two superimposed target sheets, with a portion of the top sheet broken away to show the bottom sheet.

The repeated shooting at just one area of the panels 52 of device 20 or panels 120 of device 100, as would result from target shooting, would cause the panels, especially the forward-most panels, to wear out or "core" in that area, requiring replacement even though the rest of the panel is still in relatively good condition. It is therefore desirable to spread the shots over as much of the surface of the panels as possible. To this end, a specially developed target means can be used with the bullet trap devices 20 and 100 of this invention. This target means is shown in FIG. 6 and comprises at least two target sheets 200 and 202. Each target sheet is adapted to be positioned over the forwardmost panel of the bullet trap device or the bullet trap cell. Each target sheet has at least one target means thereon, which would be located over a different portion of the panels than the target on the other sheet when the target sheets are positioned over the panels.

As shown in FIG. 6, sheet 202 is superimposed over sheet 200, but part of sheet 202 is broken away to show sheet 200. Target sheet 200 has a plurality of targets 200*a*–200*i* thereon, arranged in a pattern. Target sheet 202 has a plurality of targets 202*a*–202*d* thereon, (202*a* and 202*c* being shown in phantom) with the targets of each sheet centered over the interstices between the targets on the other sheet.

One of the target sheets, for example 200, is positioned over the panels on one of the bullet trap devices 20 or 100 and the targets 200*a*–200*i* are used for target practice. After all of the targets have been used, the other target sheet, (sheet 202), is then positioned over the panels to direct the shots toward the unused portions of the panels, thus spreading the shots over more of the surface of the panels. It is apparent that additional sheets with targets over the interstices between the targets on sheets 200 and 202 could be provided. Furthermore the number or arrangement of the targets on the sheets could be changed.

There are various changes and modifications that could be made to the invention as would be apparent to one of ordinary skill in the art. However any of these changes and modifications are included in the teaching of this disclosure, and the inventor intends that the invention be limited only by the scope of the claims.

I claim:

1. A portable bullet trap device for catching bullets fired at the device, comprising:

a box comprising a bottom, a top, and a front, back, and opposing sides extending between the bottom and the top, the front having an opening therein for the passage of bullets fired at the device;

a plurality of vertically oriented resilient energy absorbing bullet-penetrable panels in the box adapted for absorbing energy from bullets penetrating the panels, the panels aligned with the opening in the front;

means for spacing the panels from each other to form open spaces between the central portions of successive panels through which spent bullets can fall if they cannot penetrate the next successive panel, said spacing means comprising spacers between the marginal edges of adjacent panels.

2. The portable bullet trap device according to claim 1 further comprising space in the box below the panels for spent bullets to collect.

3. The portable bullet trap according to claim 1 wherein there are spacers at the top and side edges of the panels.

4. The portable bullet trap device according to claim 1 further comprising target means comprising:

at least two target sheets, each sheet adapted to be positioned over the forwardmost panel of the bullet trap device, each target sheet having at least one target thereon, the target on each sheet being located over a different portion of the panel than the target on the other sheet, when the sheet is positioned over the panel.

5. The portable bullet trap according to claim 4 wherein each target sheet has a plurality of targets thereon, with the targets of one sheet centered over the interstices between the targets on the other sheet.

6. A portable bullet trap device for catching bullets fired at the device, comprising:

a box comprising a bottom, a top, and front, back, and opposing sides extending between the bottom and the top, the front having an opening therein for the passage of bullets fired at the device;

a plurality of vertically oriented resilient energy absorbing bullet-penetrable panels in the box adapted for absorbing energy from bullets penetrating the panels, the panels aligned with the opening in the front;

means for spacing the panels from each other to form open spaces between the central portions of successive panels through which spent bullets can fall if they cannot penetrate the next successive panel, said spacing means comprising a plurality of pairs of aligned slots in the opposing sides of the box for receiving the marginal side edges of the panels, the slots terminating above the bottom of the box forming a shoulder to support the panels above the bottom of the box and form a space at the bottom of the box for spent bullets to collect.

7. The portable bullet trap device according to claim 6 further comprising target means comprising:

at least two target sheets, each sheet adapted to be positioned over the forwardmost panel of the bullet trap device, each target sheet having at least one target thereon, the target on each sheet being located over a different portion of the panel than the target on the other sheet, when the sheet is positioned over the panel.

8. The portable bullet trap according to claim 7 wherein each target sheet has a plurality of targets thereon, with the targets of one sheet centered over the interstices between the targets on the other sheet.

9. A portable bullet trap device and replaceable bullet trap cell combination for catching bullets fired at the device, the device comprising:

a box for receiving the bullet trap cell, the box comprising a bottom, a top, and front, back, and opposing sides extending between the bottom and top, the front having an opening therein for the passage of bullets fired at the device, the box further comprising means for supporting the bullet trap cell in the box, in alignment with the opening in the front and above the bottom of the box to form a space at the bottom for spent bullets to collect;

and the bullet trap cell comprising:

a plurality of panels of resilient energy absorbing bullet-penetrable material aligned in face-to-face relation;

spacers sandwiched between successive panels, the spacers positioned generally adjacent the marginal edges of the panels to form open spaces between the central portions of successive panels through which spent bullets can fall if they cannot penetrate the next successive panel.

10. The combination according to claim 9 wherein the opening in the front of the box is sized so that the front covers the marginal portions of the panels where the spacers are located.

11. The combination according to claim 9 further comprising target means comprising:

at least two target sheets, each sheet adapted to be positioned over the forwardmost panel, each target sheet having at least one target thereon, the target on each sheet being located over a different portion of the panel than the target on the other sheet, when the sheet is positioned over the panel.

12. The combination according to claim 11 wherein each target sheet has a plurality of targets thereon arranged in a pattern, with the targets of one sheet centered over the interstices between the targets on the other sheet.

13. A bullet trap cell for installation in a bullet trap device to catch bullets fired at the device, the cell comprising:

a plurality of panels of resilient energy absorbing bullet-penetrable material aligned in face-to-face relation;

spacers sandwiched between successive panels, the spacers positioned generally adjacent the marginal edges of the panels to provide open spaces between the central portions of successive panels through which spent bullets can fall if they cannot penetrate the next successive panel.

14. The bullet trap cell according to claim 13 wherein the resilient panels include a layer of fiber reinforcement.

15. The bullet trap cell according to claim 13 wherein the spacers are positioned at the top and side marginal edges of the panels.

16. The bullet trap cell according to claim 13 wherein there are eight panels.

17. The bullet trap cell according to claim 13 wherein there are one-inch spaces between successive panels.

18. A bullet trap and target combination, the bullet trap comprising:

a plurality of panels of resilient energy absorbing bullet-penetrable material aligned in face-to-face relation;

spacers sandwiched between successive panels, the spacers positioned generally adjacent the marginal edges of the panels to provide open spaces between the central portions of successive panels through which spent bullets can fall if they cannot penetrate the next successive panel;

and the target means comprising:

at least two target sheets, each sheet adapted to be positioned over the forwardmost panel of the bullet trap, each target sheet having at least one target thereon, the target on each sheet being located over a different portion of the panel than the target on the other sheet, when the sheet is positioned over the panel.

19. The bullet trap and target combination according to claim 18 wherein each target sheet has a plurality of targets thereon arranged in a pattern, with the targets of one sheet centered over the interstices between the targets on the other sheet.

* * * * *